United States Patent [19]

Carlson et al.

[11] 4,226,442

[45] Oct. 7, 1980

[54] WATER INSENSITIVE IMAGE RECEPTOR COATING

[75] Inventors: Gene D. Carlson, Ankeng; Gerry H. Ehrhardt, Des Moines, both of Iowa

[73] Assignee: Frye Copysystems, Inc., Des Moines, Iowa

[21] Appl. No.: 34,029

[22] Filed: Apr. 27, 1979

[51] Int. Cl.[3] ..... B41M 5/22

[52] U.S. Cl. ..... 282/27.5; 106/21; 427/150; 427/151; 428/524; 428/530; 428/914

[58] Field of Search ..... 106/21; 282/27.5; 427/150, 151; 428/307, 411, 537, 913, 914, 524, 530

[56] References Cited

U.S. PATENT DOCUMENTS

| | | | |
|---|---|---|---|
| 3,672,935 | 6/1972 | Miller et al. | 282/27.5 |
| 3,894,168 | 7/1975 | Brockett et al. | 428/537 X |
| 3,955,025 | 5/1976 | Matsukawa et al. | 282/27.5 X |
| 4,065,158 | 12/1977 | Davis | 282/27.5 X |

*Primary Examiner*—Bruce H. Hess

*Attorney, Agent, or Firm*—Nims, Howes, Collison & Isner

[57] ABSTRACT

A water insensitive image receptor coating composition for pressure sensitive carbonless type transfer media.

3 Claims, 1 Drawing Figure

WATER INSENSITIVE IMAGE RECEPTOR COATING

Figure 1:
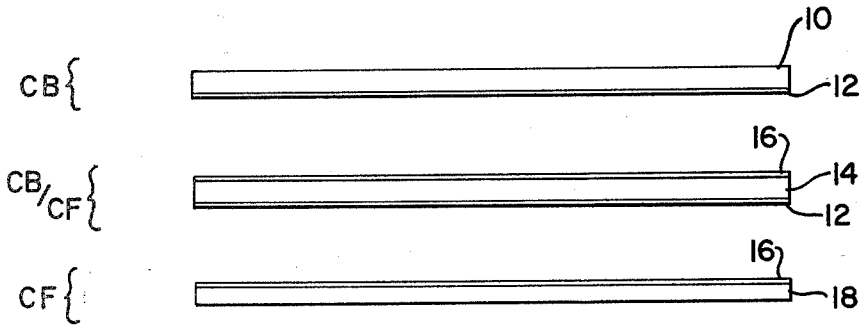

This invention relates to pressure sensitive chemical type transfer and reproduction media for effecting duplicative image transfer on sheet material in response to selectively applied pressure and to processes for forming the same and particularly to an improved water insensitive image receptor coating composition.

Pressure sensitive image transfer media of diverse character are widely employed in the information recording and duplicating arts. Chemical type or so-called "carbonless" pressure sensitive transfer and duplicating systems, wherein a visable image is formed by the selective chemical reaction of two essentially colorless reagents, have been long recognized as a viable expedient for the formation of duplicate copy material. Such systems normally broadly comprise a substrate supported coating that contains a first normally inactive chemical reagent material that is selectively transferable in response to applied pressure into a reaction providing and color producing relationship with a second normally inactive chemical reagent material contained within or comprising a second coating disposed on the surface of an interfacially contiguous second substrate. Conventionally illustrative of such chemical type reproduction systems are transfer and duplicating systems wherein the rear surface on one paper sheet substrate is provided with a coating and which sheet is then termed a "CB" (i.e. coated back) sheet and the front side of that same and/or separate paper sheet substrate is provided with a coating which is then termed a "CFB" (i.e. coated front and back) or "CF" (i.e. coated front) sheet, respectively. When the coatings on a CB and a CF sheet are placed in interfacially contiguous relation and subjected to selectively applied pressure, as by the pressure of a stylus or the impact of a typewriter key on the obverse surface of the CB sheet, the operative and usually colorless chemical reagents in such coatings are brought into co-reactive relationship, as for example on the surface of the CF sheet, to produce a colored image conforming to the contour of the selectively applied pressure member.

Such chemical type pressure sensitive transfer and duplicating systems are in widespread and expanding use at the present time for the making of multiple copies of selectively recordable duplicative information on sheet material, such as paper and the like, due, at least in part, to their basic cleanliness and to the fact that the color producing reagents are inactive until placed into operative co-reactive relationship in response to selective application of pressure.

Although it was early recognized, as for example in the Gill U.S. Pat. No. 1,781,902, that many colorless chemical reagents were capable of producing a visable colored image upon interreaction therebetween, most of the systems in wide commercial usage at the present time employ a colorless organic dyestuff as a dye precursor in encapsulated liquid form distributed within the CB sheet coating and an electron accepting material in the CF sheet coating. When such CB and CF sheet coatings are placed in contiguous interfacial relation, the application of pressure effects a rupture of the liquid dyestuff confining capsular elements in the area of applied pressure to effect a release of the dye precursor material and selective transfer of at least a portion thereof into co-reacting and color producing relationship with the electron accepting material in the contiguous coating on the CF sheet with the resulting formation of a duplicative image thereon.

Some early and relatively recent patents that illustratively disclose chemical type or so-called "carbonless" transfer media employing encapsulated dye precursor materials as the chromogenic reagent in the CB coating and electron accepting materials as the chromogenic reagent in the CF coating are U.S. Pat. No. 2,712,507 (1955) to Green; U.S. Pat. No. 2,730,456 (1956) to Green et al.; and U.S. Pat. No. 3,455,721 (1969) to Phillips et al.

Other more recent patents that illustratively disclose the disposition of the dye precursor material in the CF coating and encapsulated electron accepting material in the CB coating include U.S. Pat. No. 3,787,325 (1974) to Hoover and U.S. Pat No. 3,894,168 (1975) to Brockett et al.

Such "carbonless" transfer media as presently commercially employed and particularly those that conventionally employ an encapsulated type vehicle for one of the reactive constituents, most usually an organic dyestuff, are not without disadvantage. Among the recognized disadvantages of such media are the fact that they are not only relatively expensive, requiring specialized fabricating techniques, but are also unduly pressure sensitive. Such undue sensitivity often results in undesired premature transfer occasioned by inadvertent dye precursor release and transfer resulting from pressures normally attendant packaging, handling and processing operations, spot coating delineation, printing operations and the like, particularly where multicopy manifolding operations are involved. In addition, such media are inherently subject to a progressively increasing lack of copy definition as the number of desired copies increases as well as by a fading of the copied image with time.

In chemical transfer systems of the type wherein an organic dyestuff dye precursor is incorporated in the image receptor or CF coating and particularly in systems wherein metallic salts such as zinc chloride are employed as the electron acceptor material chromogenic reagent, the fading of the copied images with the passage of time has been a particularly vexatious problem. We have found that such fading is, in most instances, attributable to a reversion of the organic dyestuff component back into its colorless or dye precursor form and that such is often occasioned by the exposure of the transferred image to excess amounts of water.

This invention may be briefly described as an improved solvent system type image receptor or CF coating that is effectively water insensitive and is characterized by a markedly high degree of image intensity retention with the passage of time. In its broader aspects the subject invention includes an improved and highly water insensitive CF coating in which a water insoluble organic dyestuff dye precursor is dispersed, together with an opacifier-filler material, within a binder film of hydrophobic resinous material.

Among the manifold advantages attendant the practice of the subject invention is the provision of improved CF sheets that are selectively responsive to desired image transfer upon pressure application and which are characterized by a markedly higher degree of image intensity retention upon exposure to excessive amounts of moisture.

The principal object of this invention is the provision of an improved CF coating composition for pressure sensitive transfer media.

Another object of this invention is the provision of an improved water insensitive CF coating composition employing an organic dyestuff dye precursor that is possessed of a high degree of image intensity retention.

Still another object of the subject invention is the provision of an improved CF coating composition that is markedly insensitive to the presence of excessive amounts of moisture.

Other objects and advantages of the subject invention will become apparent from the following portions of this specification which describe, in accord with the mandate of the patent statutes, the principles of the invention and the best mode presently contemplated by the inventors for carrying out said invention.

FIG. 1 is a schematic representation of chemical type pressure sensitive transfer and reproduction media incorporating the principles of this invention.

Referring to the drawings, there is shown an illustrative set of chemical type or carbonless transfer and reproduction media fabricated in accord with the principles of the invention. As there shown, such set includes a CB sheet comprising a first planar substrate 10, suitably a paper sheet or web having a CB coating 12 disposed on the undersurface thereof and containing an electron acceptor chromogenic reagent material therein. Adapted to be positioned in interfacially contiguous relation with the CB coating 12 on the underside of substrate 10 is a CF sheet coating 16, constituted as hereinafter described, disposed on the upper surface of a second paper sheet substrate 14. Such substrate 14 may have its undersurface uncoated and thus constitute a "CF" sheet, or may also include a CB coating 12 on its undersurface and thus constitute a "CFB" sheet. Alternatively, and illustratively adapted to be disposed in interfacially contiguous relation with either a CB coating 12 on the underside of the "CFB" sheet 14 or with a CB coating 12 on the underside of the "CB" sheet 10, is a "CF" sheet having a CF coating 16 disposed on the upper surface of a third substrate 18. As will be apparent to those skilled in this art, any number of intermediate CFB sheets or webs 14 may be interposed in stacked relation to form a multi-lamina transfer and reproduction system. Likewise, such multi-lamina set may include one time carbon transfer sheets interposed with uncoated or CB coated sheets or webs in a manifold arrangement in accord with the dictates of the user thereof.

The CB coating 12 on the rear of sheet 10 may be of conventional character incorporating an electron accepting acid reacting material therein, as for example, of the type disclosed in the above mentioned patents to Hoover (U.S. Pat. No. 3,787,325) and Brockett (U.S. Pat. No. 3,894,168).

In its broad aspects, the improved CF sheet coating comprises the solid residue of an applied liquid mix, such solid residue being composed of about 5 to 45% of a hydrophobic resin such as polyvinyl butyral, from about 2 to 15% of an intermixture of organic dyestuff dye precursors, about 45–75% of opacifier-filler material and less than 1% each of a dispersant and an alkali hydroxide.

In its more narrow aspects, such CF coating more preferably comprises the solid residue of an applied intermix made up of about 50 to 55 parts of 95% ethyl alcohol and about 10 parts of methyl ethyl ketone, having dissolved therein at least about 2 to 7 parts of a polyvinyl butyral as a binder. Added thereto is about 0.2 parts of a dispersant and about 0.02 to 0.4 parts of dry potassium hydroxide to provide an alkaline cast to the mix and to minimize the inadvertent color reactions on the CF coated sheet. Also included in the mix is about 20 to 30 parts of an opacifier-filler, suitably a mixture of finely divided titanium dioxide and calcium carbonate. While any suitable chromogenic reagent material may be employed, satisfactory results have been obtained through the utilization of small but critical quantities of a primary organic dyestuff dye precursor, such as about ½ to 2 parts of crystal violet lactone. Preferably, additional small amounts of organic dyestuff dye precursor materials serving as color modifiers and intensifiers may also be included in the chromogenic reagent material, suitably red and olive color organic dyestuff dye precursors.

The required hydrophobic binder material, which is readily soluble in the above described composite ethyl alcohol-methyl ethyl ketone evaporable solvent carrier, preferably comprises polyvinylbutyral. Other suitable hydrophobic resins include polyvinylacetal and polyvinylformal. More specifically suitable polyvinylbutyrals comprise the Butvar polyvinylbutyral resins which are manufactured by Monsanto Polymers and Petrochemicals Co. and a preferred resin is Butvar B-98. Such butvar B-98 have an average molecular weight of 30,000 to 34,000; a hydroxyl content, expressed as % polyvinyl alcohol, of 18 to 20; an acetate content, expressed as % polyvinylacetate, of 0 to 2.5 and a butyral content, expressed as % polyvinylbutyral, of about 80.

A presently preferred dispersant comprises a sodium salt of polymeric carboxylic acid such as Tamol 731 as manufactured by Rohm & Haas Company of Philadelphia, Pa. Such material has about 30% solids, a pH of about 9.8 and a specific gravity of 1.19 at 25° C.

The chromogenic material may be of conventional character and a presently preferred material comprises "Brillant Violet Leuco" (CVL) as manufactured by the Hilton Davis Chemical Company of Cincinnati, Ohio. This particular material is believed to be 6-dimethylamino-3, 3-(p-dimethylaminophenyl) phthalide having a molecular formula of $C_{26}H_{19}N_3O_2$.

In the production of the above described receptor coating for CF sheet, a liquid mixture is first formed by (a) intermixing the ethyl alcohol and methylethylketone solvents; then (b) the polyvinylbutyral binder material, the dispersant, the potassium hydroxide are added with continuous agitation to dissolve such constituents in the solvent. After complete dissolution, the organic dyestuff dye precursor materials are added with continuous stirring to dissolve the dye precursor and to obtain a uniform distribution of the chromogenic material therewithin. To the above liquid mixture is then added the requisite amounts of the calcium carbonate-titanium dioxide opacifier-fillers. Such addition should be accompanied by continuous stirring of the constituents in the liquid vehicle to obtain a uniform dispersion of the opacifier-filler therewithin.

The above described organic dyestuff dye precursor materials are stable in alkaline media and, within the above formulation ranges, such coating composition can be used to coat most all paper substrates without any appreciable effect on the reaction time or the intensity of the image produced.

By way of specific example, the following formulations have provided CF sheet coating of improved image intensity with time.

EXAMPLE I

| Raw Materials | % |
|---|---|
| Ethyl Alcohol (95%) | 53.28 |
| Polyvinyl Butyral | 4.0 |
| Potassium Hydroxide Flakes | 0.12 |
| Tamol 731 S.D. Dispersant | 0.2 |
| Titanium Dioxide | 5.0 |
| Calcium Carbonate | 25.0 |
| Methyl Ethyl Ketone | 10.0 |
| Crystal Violet Lactone (CVL) | 1.2 |
| Red Color Precursor | 0.6 |
| Olive Color Precursor | 0.6 |

EXAMPLE II

| | % |
|---|---|
| Ethyl Alcohol (95%) | 53.50 |
| Polyvinyl Formal | 10.0 |
| Tamol 731 Dispersant | 0.2 |
| Potassium Hydroxide | 0.10 |
| Titanium Dioxide | 5.0 |
| Calcium carbonate | 20.0 |
| Methyl Ethyl Ketone | 10.0 |
| Crystal Violet Lactone (CVL) | 1.2 |

Having thus described our invention, we claim:

1. A pressure responsive receptor sheet for chemical type transfer media adapted to produce a moisture insensitive transferred image comprising planar sheet material having a nontransferable image receptor coating layer disposed on one surface thereof, said nontransferable image receptor coating layer comprising the solid residue of an applied homogenous liquid mixture of an evaporable liquid carrier, a hydrophobic resinous binder material selected from the group consisting of polyvinyl butyral, polyvinylacetal and polyvinyl formal, opacifier-filler material and organic dyestuff dye precursor chromogenic reagent material distributed therewithin.

2. A pressure sensitive chemical type transfer medium as set forth in claim 1 further including alkali hydroxide to insure an alkaline cast to the coating layer.

3. A pressure responsive receptor sheet for chemical type transfer media adapted to produce a water insensitive transferred image comprising planar sheet material having a nontransferable image receptor coating disposed on one surface thereof, said nontransferable image receptor coating layer comprising about 45 to 75% of opacifier-filler material;

about 5 to 45% polyvinyl butyral as a hydrophobic binder material;

about 2 to 15% of organic dyestuff dye precursor material, and a small amount of alkali hydroxide to insure an alkaline cast to the coating layer.

* * * * *